US005353927A

United States Patent [19]

Stupar et al.

[11] Patent Number: 5,353,927

[45] Date of Patent: Oct. 11, 1994

[54] PLURAL COMPARTMENT PACKAGE

[75] Inventors: Jeffrey M. Stupar, West Dundee; Donald L. Van Erden, Wildwood; Guenther R. Kram, Bartlett, all of Ill.

[73] Assignee: Illinois Tool Works Inc., Glenview, Ill.

[21] Appl. No.: 21,787

[22] Filed: Feb. 24, 1993

[51] Int. Cl.[5] ..... B65D 25/08

[52] U.S. Cl. ..... 206/219; 383/38

[58] Field of Search ..... 206/219, 222; 383/38, 383/40

[56] References Cited

U.S. PATENT DOCUMENTS

| | | | |
|---|---|---|---|
| 2,756,875 | 7/1956 | Yochim | 206/219 |
| 3,074,544 | 1/1963 | Bollmeier et al. | 206/219 |
| 3,149,943 | 9/1964 | Amador | 62/4 |
| 3,608,709 | 9/1971 | Pike | 206/47 |
| 3,692,493 | 9/1972 | Terasaki | 206/219 X |
| 3,756,389 | 9/1973 | Firth | 206/219 |
| 3,950,158 | 4/1976 | Gossett | 62/4 |
| 3,983,994 | 10/1976 | Wyslotsky | 206/219 |
| 4,106,478 | 8/1978 | Higashijima | 206/219 X |
| 4,458,811 | 7/1984 | Wilkinson | 206/219 |
| 4,462,224 | 7/1984 | Dunshee et al. | 206/219 X |
| 4,519,499 | 5/1985 | Stone et al. | 206/222 X |
| 4,557,377 | 12/1985 | Maloney | 206/219 |
| 4,846,585 | 7/1989 | Boeckmann et al. | 383/5 |
| 4,856,651 | 8/1989 | Francis, Jr. | 206/219 |
| 4,872,556 | 10/1989 | Farmer | 206/484 |

FOREIGN PATENT DOCUMENTS 2134067 8/1984 United Kingdom .

OTHER PUBLICATIONS

European Patent Application 100796 Feb. 22, 1984.

*Primary Examiner*—Paul T. Sewell
*Assistant Examiner*—Ted Kavanaugh
*Attorney, Agent, or Firm*—Schwartz & Weinrieb

[57] ABSTRACT

The present invention is a package for housing and mixing two materials, such as epoxy resin and polyamine adduct, together to form an adhesive. Two sheets are joined together to form the outer periphery of the bag. A third sheet is secured between the outer sheets and divides the package into two compartments. One compartment includes a line of perforation holes that are easily ruptured when a user applies pressure to the external area of the compartment. A cap covers the perforation holes so that the material contained within the rupturable bag will not leak into the other compartment. When the one compartment is ruptured, the adduct that is contained therein is released into the other compartment and mixes with the resin. After the two materials are completely mixed the adhesive is ready for use.

20 Claims, 1 Drawing Sheet

PLURAL COMPARTMENT PACKAGE

FIELD OF THE INVENTION

The present invention is generally directed to a package for mixing two materials together to form a compound. More particularly, the package has two compartments with each one holding a separate material. A weakened area in one of the compartments breaks under external pressure so as to facilitate the mixing of the materials.

BACKGROUND OF THE INVENTION

Prior art packages use a bag-in-bag type apparatus for mixing two materials together. For example, an inner rupturable bag is surrounded by an outer sealed bag. When pressure is applied to the exterior of the outer bag, a seal in the inner bag ruptures under the pressure and releases the material contained within the inner bag. The contents of the inner bag and the contents of the outer bag mix together so as to form the completed mixture.

This type of prior art bag, however, has several disadvantages. It uses a substantial amount of material to make the completed bag since it uses two separate bags. Also, it is difficult to break the inner bag since a seal must be ruptured to release the inner bag's contents.

The present invention is intended to overcome or minimize all of these problems, as well as to present several other advantages.

OBJECTS OF THE INVENTION

A general object of the present invention is to provide an improved package or bag for holding and mixing two materials.

Another object of the present invention is to provide an improved package that allows a user to easily and quickly mix the two materials.

A further object of the present invention is to provide an improved bag that uses two separate compartments for holding the materials where one compartment is easily rupturable.

A specific object of the present invention is to provide an improved bag that prevents leaking between the compartments so that the materials will not mix together before the one compartment is ruptured.

SUMMARY OF THE INVENTION

Briefly, and in accordance with the foregoing, the present invention includes a package for housing and mixing two materials, such as epoxy resin and polyamine adduct, together so as to form an adhesive. Two sheets are joined together so as to form the outer periphery of the bag. A third sheet is secured between the outer sheets and divides the package into two compartments. One compartment includes a line of perforation holes that are easily ruptured when a user applies pressure to the external area of the compartment. A cap covers the perforation holes so that the material contained within the rupturable bag will not leak into the other compartment. When the one compartment is ruptured, the adduct that is contained therein is released into the other compartment and mixes with the resin. After the two materials are completely mixed together the adhesive is ready for use.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements throughout the several views and in which.

DETAILED DESCRIPTION OF THE PREFERRED EMBODIMENT

Figure 1:
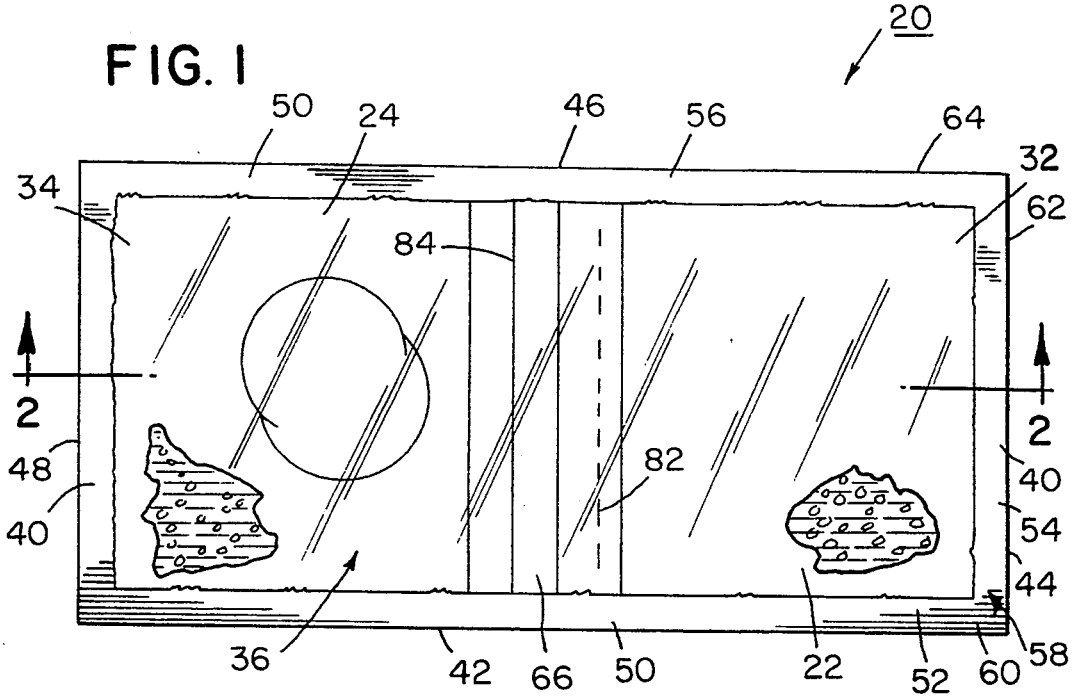
FIG. 1 is a top view of a package according to the present invention.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 2:
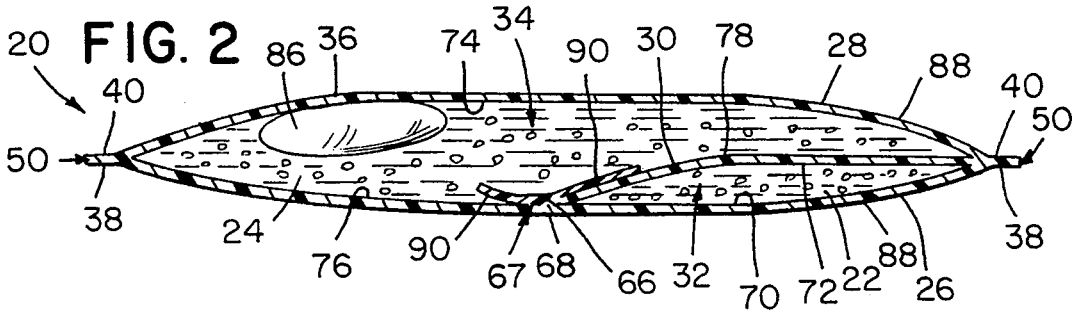
FIG. 2 is a cross sectional view of the package along line 2—2 of FIG. 1.
Figure 3:
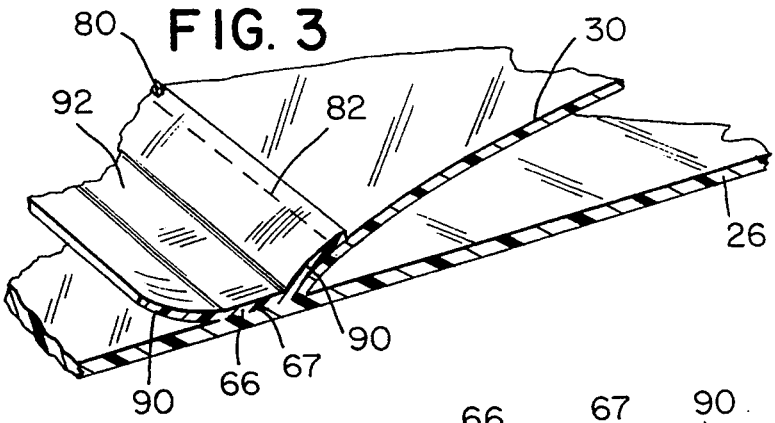
FIG. 3 is a partial, perspective sectional view of a connection between first and third sheets of the package according to the present invention.
Figure 4:
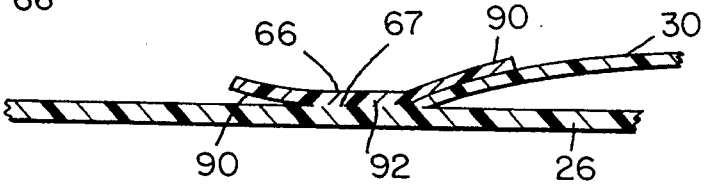
FIG. 4 is a partial cross sectional view of the connection between the first and third sheets of the package according to the present invention.

As illustrated in FIG. 1, the present invention comprises a flexible package or bag 20 that is used for holding and mixing two materials 22, 24, such as an polyamine adduct 22 and a epoxy resin 24, into an adhesive material. Of course, other types of two component material to be mixed can be similarly packaged. The package 20 is only used once and then discarded. As clearly shown in FIG. 2, the package or bag 20 is generally comprised of three joined sheets 26, 28, 30 that form a plurality of compartments 32, 34.

In the preferred embodiment, the package or bag 20 is divided into two compartments 32, 34 with one compartment 34 being substantially larger than the other compartment 32. Each compartment 32, 34 holds a separate material 22, 24 therein. In the preferred embodiment, the larger compartment 34 houses the epoxy resin 24 and the smaller compartment 32 houses the polyamine adduct 22.

A first sheet 26 and a second sheet 28 are joined together so as to form an outside wall 36 of the package 20. The sheets 26, 28 are of equal size and completely overlap each other when the package 20 is assembled. The sheets 26, 28 may take one of many forms and in the preferred embodiment, the sheets 26, 28 are rectangular. To join the sheets 26, 28, an area 38, 40 around each of their edges 42, 44, 46, 48 is bonded together by appropriate means, such as a heat seal. Thus, an outer heat seal 50 is formed around the entire outer extent of the package 20.

The compartments 32, 34 that hold the materials 22, 24 are defined by the addition of a third sheet 30 which is located between the first 26 and second sheets 28. The third sheet 30 is attached at three sides 52, 54, 56 to the first 26 and second sheets 28 along an area 58 around the third sheet's edge 60, 62, 64 by the outer heat seal 50. The fourth side 66 of the third sheet 30 is substantially attached only to the first sheet 26. However, part of the fourth side 66 will be attached to the second sheet 28 since it lies along the area 58 that is captured in the outer heat seal 50. The entire length of the fourth side 66 of the third sheet 30 is bonded to the first sheet 26 by appropriate means, such as a heat seal 67.

In the preferred embodiment, the third sheet 30 is shorter than the first 26 or second sheet 28 and is approximately one-half of the length of the first 26 and second sheet 28. Thus, the third sheet 30 is bonded to the first sheet 26 at approximately the first sheet's mid point 68. It is contemplated, however, that the third sheet 30 may be approximately the same length as the first 26 and second sheet 28 or longer than one half of the first 26 and second sheet 28.

Thus, part of the inner wall 70 of the first sheet 26, in the preferred embodiment approximately one half of the length, and one side 72 of the third sheet 30 define the smaller compartment 32. The larger compartment 34 is defined by the inner wall 74 of the second sheet 28, the other half of the inner wall 76 of the first sheet 26 and the other side 78 of the third sheet 30. The third sheet 30 is substantially thinner than the first 26 and second sheets 28 in order to be more easily rupturable as described herein.

Each of the sheets 26, 28, 30 are formed from a suitable plastic materials, preferably heat sealable. In the preferred embodiment, the third sheet 30 is made from a random copolymer polypropylene film and the first and second sheets 26,28 are made from a biaxially oriented polypropylene film or a metallized biaxially oriented polypropylene film with heat sealable coating or a polypropylene/polyester film type LF4101. The sheet materials are dependent on the type of adhesive materials to be used. For example, in a 2-ton clear epoxy hardener, the preferred adhesive materials are polyamine adduct and epoxy resin, and the sheet materials are random copolymer polypropylene or 0.00075" clear biaxially oriented polypropylene/0.00070" metallized biaxially oriented polypropylene with heat sealable coating film. In a 5-minute clear epoxy hardener, the preferred adhesive materials are epoxy resin and a polymercaptan/polyamine mixture, and the sheet materials are random copolymer polypropylene or 0.00075" clear biaxially oriented polypropylene/0.00070" metallized biaxially oriented polypropylene with heat sealable coating film or polypropylenepolyester type LF4101.

In order to release the polyamine adduct 22 that is held in the smaller compartment 32 so that the adduct 22 may mix with the resin 24, a weakened area 80 is provided in the smaller compartment 32 that allows the smaller compartment 32 to burst under external pressure. The weakened area 80 is created by a line of perforations 82 that are at a location that is offset from the edge 84 of the fourth side 66 of the third sheet 30. The line of perforations 82 extends laterally across the entire width of the third sheet 30 at a position that is parallel to the heat seal 67.

In the preferred embodiment, the smaller compartment 32 is almost completely full of adduct 22 while the larger compartment 34 is approximately three-quarters full with resin 24. Having the smaller compartment 32 be almost completely full of adduct 22 will allow the smaller compartment 32 to burst more easily as described herein. Air bubbles 86 may form within the adduct 22 or resin 24 depending on the amount of material within the compartment. While one embodiment is depicted in the Figs., it is to be understood that various amounts of materials may be used within the compartments depending on the desired compound to be formed.

When pressure is applied along the external portion 88 of the smaller compartment 32, the adduct 22 therein will push against the line of perforations 82 and apply pressure to the weakened area 80. When the pressure on the weakened area 80 becomes too great, the line of perforations 82 will burst apart and release the adduct 22 into the resin 24. Thereafter, the user applies pressure along the exterior 88 of the smaller compartment 32 and flattens the compartment 32 until all of the adduct 22 has been discharged. In order to form the adhesive, the user kneads the exterior of the package 20 thereby mixing the adduct 22 and resin 24 together. After the adduct 22 and resin 24 have been completely mixed, the adhesive is dispensed from the package 20 by appropriate means, such as cutting or tearing the package 20 open.

An additional feature that is included in the package 20 is a thin membrane or cap 90 that completely covers the line of perforations 82 in order to prevent any adduct 22 from leaking into the resin 24. The cap 90 is formed from an extruded piece of material and is made of a suitable plastic material such as random copolymer polypropylene. In the preferred embodiment of the invention, the cap 90 material is Ethylene Methyl Acrylate Copolymer, preferably Exxon TC-120.

The cap 90 is attached to the third sheet by appropriate means. In the preferred embodiment, a frangible cap 90 is extruded onto the line of perforations 82 of the third sheet 30 and completely covers the weakened area 80. Part of the cap 90 is captured in the heat seal 67 along the fourth side 66 of the third sheet 30. When pressure is applied along the exterior 88 of the area of the package 20 containing the smaller compartment 32, the adduct 22 pushes against the weakened area 80. When the pressure becomes too great, the line of perforations 82 burst apart and the cap 90 is fractured. Part of the cap remains attached along one side of the broken line of perforations and the other part of the cap remains attached along the other side of the broken line of perforations. The completed adhesive can then be formed as described hereinabove.

Alternatively, one side of the cap may be captured in the heat seal 76 with the rest of the cap being bonded to the third sheet 30 across the weakened area 80 by a light adhesive material. When pressure is applied to the exterior 88 of the area of the package 20 containing the smaller compartment 32, the adduct 22 pushes against the weakened area 80. When the pressure becomes too great, the line of perforations 82 bursts and the light adhesive material releases the cap 90. The cap 90 is then solely held by the heat seal 76. The adduct 22 is discharged into the resin 24. Again, the completed adhesive can then be formed as described hereinabove.

One final feature of note is that a colored dye, preferably Astrazon Blue 5RL, a blue dye, can be added to the resin 24. Upon the mixing of the adduct 24 and the resin 22 as described hereinabove, the blue color disappears as the materials are mixed. The blue color completely disappears upon thorough mixing of the materials. This informs the consumer that the adduct 22 and the resin 24 have been completely mixed and the adhesive is ready for use. In the preferred embodiment, the blue dye is at a concentration of 0.044% and it is added to the resin 22 in a pigment dispersion of 25% of the Astrazon Blue 5RL; 25% dibutylphthalate and 50% epoxy resin.

An advantage to using this type of package 20 is that the adduct 22 and resin 24 can be mixed quickly, easily and thoroughly to form a uniform adhesive. An additional advantage is that less package material is required than prior art bag-in-bag type packages since the smaller compartment 32 is comprised partially of the first sheet 26.

While a preferred embodiment of the present invention is shown and described, it is envisioned that those skilled in the art may devise various modifications of the present invention without departing from the spirit and scope of the appended claims. The invention is not intended to be limited by the foregoing disclosure.

The invention claimed is:

1. A plural compartment package for mixing materials therein, comprising:

a first sheet of packaging material;

a second sheet of packaging material overlapping said first sheet of packaging material;

said first and second sheets of packaging material being joined together such that an area is defined therebetween;

a third sheet of packaging material located between and joined to said first and second sheets of packaging material such that a first compartment for holding a first material is defined between said third sheet of packaging material and said first sheet of packaging material, and a second compartment for holding a second material is defined between said second and third sheets of packaging material;

said third sheet of packaging material having a weakened area which is rupturable upon the application of pressure thereto for enabling said first and second materials to mix together; and non-porous, rupturable cap means secured to said third sheet of packaging material and overlying said weakened area of said third sheet of packaging material for preventing discharge of said first material from said first compartment until said application of said pressure ruptures both said weakened area of said third sheet of packaging material and said cap means whereby said first material is discharged from said first compartment into said second compartment for mixing with said second material.

2. A plural compartment package as defined in claim 1, wherein:

said rupturable cap mean is attached to said third sheet of packaging material, and overlies said weakened area of said third sheet of packaging material, by means which secures a first part of said rupturable cap means to a first part of said third sheet of packaging material disposed upon a first side of said weakened area of said third sheet of packaging material, and a second part of said rupturable cap means to a second part of said third sheet of packaging material disposed upon a second side of said weakened area of said third sheet of packaging material after said weakened area of said third sheet of packaging material and said rupturable cap means are ruptured.

3. A plural compartment package as defined in claim 2, wherein:

said means securing said first and second parts of said rupturable cap means to said first and second parts of said third sheet of packaging material comprises heat seals.

4. A plural compartment package as defined in claim 1 wherein said cap means is sealed to said weakened area by a light adhesive such that when said weakened area is broken under pressure, the light adhesive material releases the cap means.

5. A plural compartment package as defined in claim 2 wherein said membrane is extruded onto said third sheet.

6. A plural compartment package as defined in claim 1 wherein said third sheet has three sides attached to said first and second sheets and a fourth side substantially attached to only said first sheet.

7. A plural compartment package as defined in claim 1 wherein said weakened area has perforations.

8. A plural compartment package as defined in claim 1 wherein said third sheet is shorter in length than said first and second sheets.

9. A plural compartment package as defined in claim 1 wherein the sheets are joined together by a heat seal.

10. A plural compartment package as defined in claim 1 wherein said first and second sheets are thicker than said third sheet.

11. A plural compartment package for mixing materials therein, comprising:

a first sheet of packaging material;

a second sheet of packaging material overlapping said first sheet of packaging material;

said first and second sheets of packaging material being joined together such that an area is defined therebetween;

a third sheet of packaging material interposed between said first and second sheets of packaging material and having three sides thereof attached to said first and second sheets of packaging material and a fourth side thereof substantially attached only to said first sheet of packaging material such that a first compartment is defined between said third sheet of packaging material and said first sheet of packaging material for holding a first material, and a second compartment is defined between said first, second, and third sheets of packaging material for holding a second material;

said third sheet of packaging material having a weakened area such that when said weakened area is broken under pressure, said materials are able to mix together; and non-porous, rupturable cap means secured to said third sheet of packaging material and overlying said weakened area of said third sheet of packaging material for preventing discharge of said first material from said first compartment until said application of said pressure ruptures both said weakened area of said third sheet of packaging material and said cap means whereby said first material is discharged from said first compartment into said second compartment for mixing with said second material.

12. A plural compartment package as defined in claim 11, wherein:

said rupturable cap means is attached to said third sheet of packaging material, and overlies said weakened area of said third sheet of packaging material, by means which secures a first part of said rupturable cap means to a first part of said third sheet of packaging material disposed upon a first side of said weakened area of said third sheet of packaging material, and a second part of said rupturable cap means to a second part of said third sheet of packaging material disposed upon a second side of said weakened area of said third sheet of packaging material after said weakened area of said third sheet of packaging material after said weakened area of said third sheet of packaging material and said rupturable cap means are ruptured.

13. A plural compartment package as defined in claim 11 wherein said weakened area has perforations.

14. A plural compartment package and two-part adhesive, comprising, in combination:

a first sheet of packaging material;

a second sheet of packaging material overlapping said first sheet of packaging material;

said first and second sheets of packaging material being joined together such that an area is defined therebetween;

a third sheet of packaging material interposed between and joined to said first and second sheets of packaging material such that a first compartment holding a polyamine adduct is defined between said third sheet of packaging material and said first sheet of packaging material, and a second compartment holding an epoxy resin is defined between said second and third sheets of packaging material;

said third sheet of packaging material having a weakened area which is rupturable upon the application of pressure thereto for enabling said polyamine adduct and said epoxy resin to mix together; and non-porous, rupturable cap means secured to said third sheet of packaging material and overlying said weakened area of said third sheet of packaging material for preventing discharge of said resin from said second compartment until said application of said pressure ruptures both said weakened area of said third sheet of packaging material and said cap means whereby said resin is discharged from said second compartment into said first compartment for mixing with said adduct.

15. A plural compartment package as set forth in claim 12, wherein:

said means securing said first and second parts of said rupturable cap means to said first and second parts of said third sheet of packaging material comprises heat seals.

16. A plural compartment package as set forth in claim 11, wherein:

a portion of said cap means which overlies said weakened area of said third sheet of packaging material is secured to said third sheet of packaging material by a light adhesive such that when said weakened area of said third sheet of packaging material is ruptured under said pressure, said light adhesive material will release said cap means from said third sheet of packaging material.

17. A plural compartment package as set forth in claim 11, wherein:

said third sheet of packaging material is shorter in length than said first and second sheets of packaging material.

18. A plural compartment as set forth in claim 11, wherein:

said first, second, and third sheets of packaging material are fabricated from polypropylene.

19. A plural compartment package as set forth in claim 14, wherein:

said rupturable cap means is attached to said third sheet of packaging material, and overlies said weakened area of said third sheet of packaging material, by means which secures a first part of said rupturable cap means to a first part of said third sheet of packaging material disposed upon a first side of said weakened area of said third sheet of packaging material, and a second part of said rupturable cap means to a second part of said third sheet of packaging material disposed upon a second side of said weakened area of said third sheet of packaging material even after said weakened area of said third sheet of packaging material and said rupturable cap means are ruptured.

20. A plural compartment package as set forth in claim 14, wherein:

a portion of said cap means which overlies said weakened area of said third sheet of packaging material is secured to said third sheet of packaging material by a light adhesive such that when said weakened area of said third sheet of packaging material is ruptured under said pressure, said light adhesive material will release said cap means from said third sheet of packaging material.

* * * * *